US005280298A

United States Patent [19]

Morin

[11] Patent Number: 5,280,298

[45] Date of Patent: Jan. 18, 1994

[54] CIRCULAR POLARIZATION SELECTIVE SURFACE MADE OF RESONANT SPIRALS

[75] Inventor: Gilbert A. Morin, Ottawa, Canada

[73] Assignee: Her Majesty the Queen in Right of Canada, as represented by the Minister of National Defence, Ottawa, Canada

[21] Appl. No.: 12,825

[22] Filed: Feb. 3, 1993

[30] Foreign Application Priority Data

Feb. 26, 1992 [CA] Canada ..... 2062029

[51] Int. Cl.[5] ..... H01Q 15/02

[52] U.S. Cl. ..... 343/909

[58] Field of Search ..... 343/909, 753, 756, 895; H01Q 15/02

[56] References Cited

U.S. PATENT DOCUMENTS 4,814,785 3/1989 Wu ..... 343/909

*Primary Examiner*—Donald Hajec
*Assistant Examiner*—Tan Ho
*Attorney, Agent, or Firm*—Michael Zelenka; William H. Anderson

[57] ABSTRACT

A Circular Polarization Selective Surface (CPSS) for circular polarized electromagnetic waves is formed from a number of resonating elements arranged in a plane. This type of surface may be used in a wide range of reflector antennas. Each resonating element is formed from a number of electrically conductive segments connected end-to-end one to the other with each segment having a predetermined length and having a total approximate length of 1λ. A central segment having a length about ¼λ determines the resonant frequency for the element. This central segment extends parallel to the z-axis of a right-hand set of three mutually perpendicular axes x, y and z wherein the circular polarized electromagnetic wave is directed along the z-axis. A second segment is connected to one end of the central segment and extends parallel to the x-axis with a third segment being connected to the other end of the central segment extending parallel to the y-axis. Shorter segments connected to outer ends of the second and third segments extend parallel to this z-axis and toward each other so that a free end of one shorter segment can be connected to a free end of a shorter segment of an adjacent resonating element forming a spiral which can be mechanically supported at its outer ends. This eliminates the need for having support structures in the active area of the surface.

18 Claims, 6 Drawing Sheets

CIRCULAR POLARIZATION SELECTIVE SURFACE MADE OF RESONANT SPIRALS

FIELD OF THE INVENTION

The invention relates to a circular polarization selective surface for a circular polarized electromagnetic wave. An ideal Circular Polarization Selective Surface (CPSS) is one that completely reflects only one sense of a circularly polarized electromagnetic wave at a given frequency but is completely transparent to the other sense of polarization without any loss or reflection at the same frequency.

BACKGROUND OF THE INVENTION

Circular Polarization Selective Surfaces (CPSS) of the present invention have similar applications to those known in the art for vertical and horizontal Linear Polarization Selective Surfaces (LPSS). The surfaces according to the present invention may be used in a wide range of reflector antennas such as in the reduction of aperture blockage by the sub-reflector of a symmetrical dual-reflector antenna, a dual-reflector antenna with a CPSS sub-reflector in which both right and left polarizations can be used at the same frequency with a separate feed network for each frequency.

Several configurations of circular polarization select surfaces are presently known in the art. These known configurations have serious disadvantages for some particular applications compared to a configuration according to the present invention.

A first known configuration is based on optics and consists of three superimposed plates. The three superimposed plates are, in order, a quarter-wave plate that changes circular polarization to linear polarization, a linear polarization selective surf ace and another quarter-wave plate that changes linear polarization into circular polarization. This type of configuration is only actually suitable for short wavelengths, such as millimeter waves, since the three plates become rather bulky for longer wavelengths.

A second known configuration uses two planar arrays wherein the first array receives the incoming signal and passes it to an array of networks. The networks discriminate between one polarization and the other and either reflects the signal back or passes it to the other array which will transmit that signal. This is a very complex design due to the large number of networks required and their physical size.

A third known configuration consists of a planar array of crossed dipoles connected by half-wavelength transmission lines the vertical dipoles in the array of crossed dipoles being separated from the horizontal dipoles by a quarter-wavelength. This type of array is disclosed in Canadian Patent Application 546,499 entitled "Polarization Selective Surface For Circular Polarization" which is assigned to Her Majesty the Queen in Right of Canada. However, the transmission lines with that configuration are difficult to make at frequencies over 1 GHz since they are very small and a practical design needs thousand of transmission lines.

A fourth known configuration consists of a planar array of a multitude of resonating elements arranged in a prescribed pattern on and in a dielectric slab. Each resonating element can be made from a straight wire which is one wavelength in length with two end sections of the wire bent at ninety degrees from the central section and from each other. The central sections are arranged parallel in the array with each end section on opposite surfaces of the array being arranged in the same direction. This type of design is described in French Patent No. 1,512,598.

The third and fourth described configurations for circular polarization selective surfaces uses dielectric slabs for mechanical support. The dielectric material, however, causes unwanted reflections of the incoming waves and also generates surface waves that degrade the performance of the array. The only practical way of reducing those reflections and surface waves is to use a dielectric of low permittivity such as Styrofoam. However, low permittivity dielectrics like Styrofoam are quite soft and cannot be precisely machined. Furthermore, they are readily deformed which makes them unsuitable as supports for these arrays.

SUMMARY OF THE INVENTION

It is an object of the present invention to provide circular polarization selective surfaces formed of elements which can be supported at their ends and require no dielectric material in active areas of the surfaces to form mechanical support for the elements.

In accordance with a preferred embodiment of the invention, a Circular Polarization Selective Surface for almost totally reflecting only one sense, while being almost transparent to the other sense, of an incoming circularly polarized wave having a wavelength $\lambda$ which propagates in a direction parallel to a z-axis of a right-hand set of three mutually perpendicular axes x, y, and z consists of at least one resonating element having a multiplicity of electrically conductive segments, each segment having a predetermined length and being connected end-to-end one to the other, a central segment having a length of about $\frac{1}{4}\lambda$ extends parallel to said z-axis with a second segment being connected to one end of the central segment extending parallel to the x-axis and a third segment having about the same length as second segment being connected to the central segment's other end, the third segment extending parallel to the y-axis, the resonating element having shorter segments of approximately equal lengths connected to outer ends of the second and third segment, wherein the shorter segments together have a total length equal to the central segment's length and extend parallel to the z-axis in opposite directions towards each other with the total length of all the segments being about $1\lambda$.

In a further embodiment, a number of identical resonating elements are connected together so as to form a spiral with an outer end of one of the shorter segments of one resonating element being connected to an outer end of another shorter segment of an adjacent resonating element, all of the second segments extending in the same direction parallel to the x-axis and all of the third segments extending in the same direction parallel to the y-axis.

In a still further embodiment, a number of the spirals are arranged parallel to each other in a single plane.

BRIEF DESCRIPTION OF THE DRAWINGS

The following detailed description of the invention will be more readily understood when considered in conjunction with accompanying drawings, in which.

DESCRIPTION OF THE PREFERRED EMBODIMENTS

Figure 1:
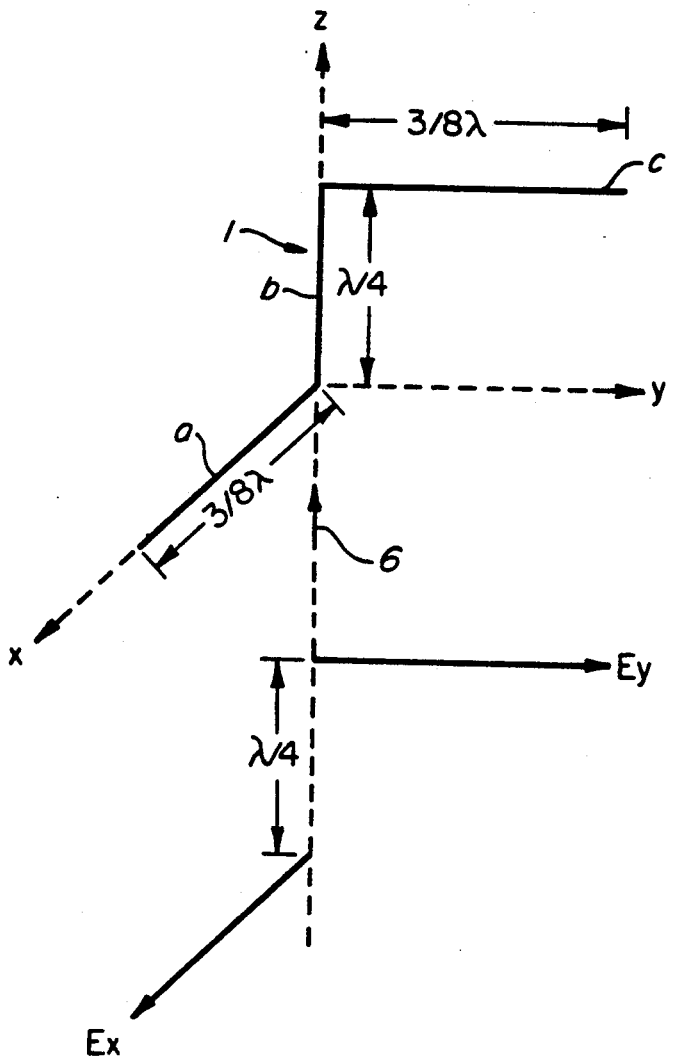
PRIOR ART FIG. 1
FIG. 1 is a view of a resonator element for a known circular polarized selective surface.

FIG. 1 illustrates a known resonating element 1 of a left circular polarization selective surface with an incoming Left Hand Circularly Polarized (LHCP) wave propagating in a direction parallel to a first axis (z). The first axis z is one of a right-hand set of axes x, y, and z which are mutually perpendicular. The element 1 is formed from a one-wavelength long single piece of wire bent as shown in FIG. 1 with a segment a, which is $\frac{3}{8}\lambda$ along, parallel to the x-axis, a segment b, which is $\frac{1}{4}\lambda$ long, parallel to the z-axis and a segment c, which is $\frac{3}{8}\lambda$ long, parallel to the y-axis.

It is useful to decompose the incoming LHCP wave into two linearly polarized components $E_x$ and $E_y$ as illustrated in FIG. 1 in order to explain the behavior of the LHCP wave resonating element 1. When an incoming LHCP wave is propagating in the +z direction, as shown by arrow 6, the $E_y$ component of the incoming LHCP wave is $\frac{1}{4}\lambda$ ahead of the $E_x$ component. The segments a and c are also separated along the z-axis by $\frac{1}{4}\lambda$ due to segment b. Therefore, each component $E_x$ and $E_y$ will arrive at the wire segments a and c with the same amplitude at the same time. This will cause two full wavelength resonances to be excited, one for each end of wire 1 which has a total length of one wavelength. The position of segments a and c cause both resonance currents to add up in phase due to the phase relationship between $E_x$ and $E_y$. This will create a strongly resonating element causing the incoming LHCP wave to be reflected. However, for an incoming Right Hand Circular Polarized (RHCP) wave the $E_y$ component would lag the $E_x$ component by $\frac{1}{4}\lambda$. This would cause the two resonances set up in segments a and c to cancel each other and the resonating element 1 would be transparent to a RHCP wave. However, the situation is reversed if the segment c extends in the negative direction of axis y and that type of resonating element would then be reflecting for an incoming RHCP wave but transparent to an incoming LHCP wave.

In order to form an array of the resonating elements 1, they must be arranged on and in a dielectric support. However, this type of dielectric support will cause unwanted reflections and also will generate surface waves which will degrade the performance of the array.

Figure 2:
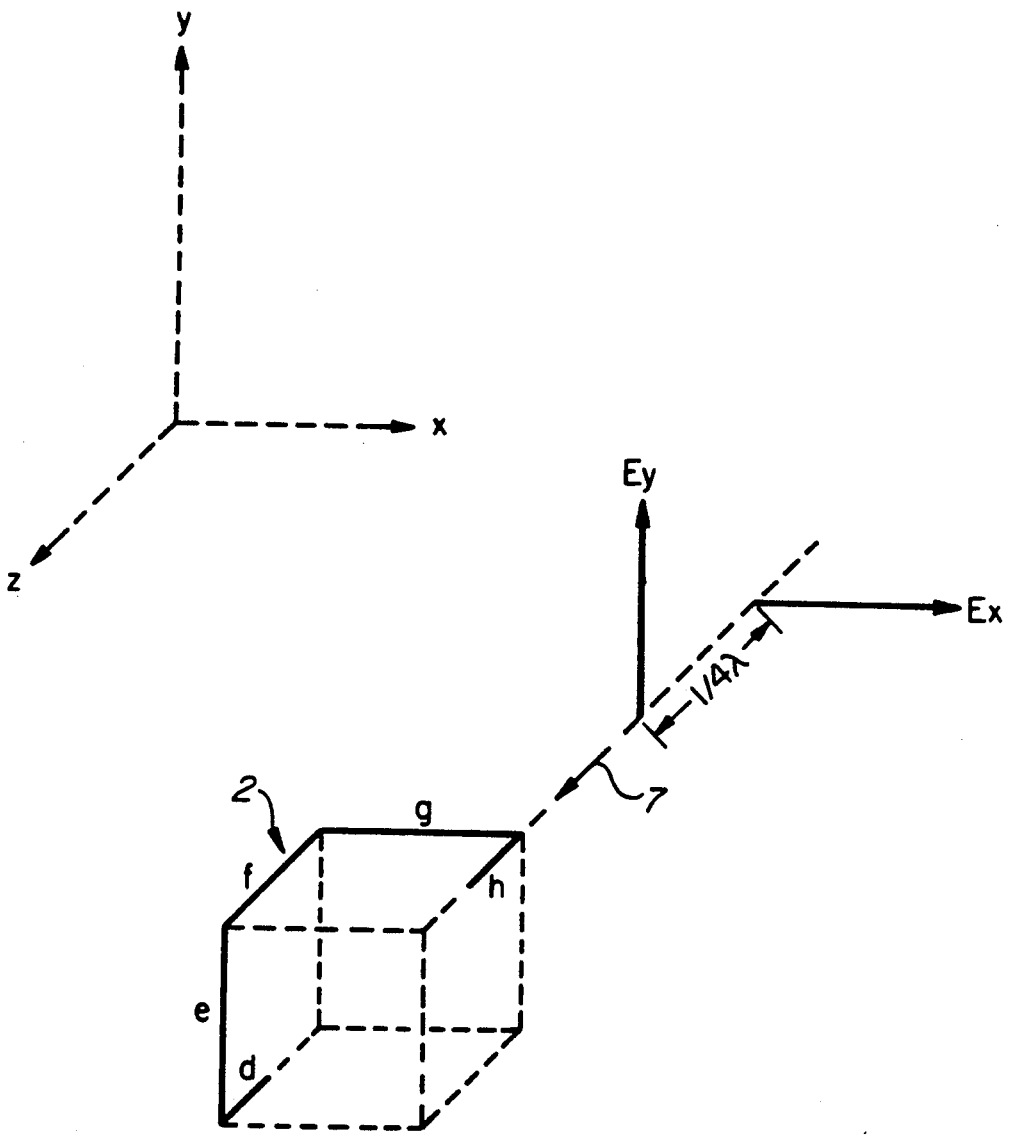
FIG. 2 is a view of a resonator element according to the present invention.

FIG. 2 shows a resonating element 2 according to the present invention which does not need any support structure other than at their outer ends even when a number of these resonating elements are connected together end-to-end forming a spiral. The resonating element 2 is formed from a conducting wire, one wavelength in length and bent into a shape that contains five straight segments d, e, f, g, and h. Each of these segments is perpendicular to an adjacent segment and parallel to one of the Cartesian axes x, y and z. Outer segments d and h and the central segment f are all parallel to the z-axis and to the direction of wave propagation as indicated by the arrow 7. Central segment f is about $\frac{1}{4}\lambda$ in length and provides a $\frac{1}{4}\lambda$ spacing between segment g, a horizontal element extending parallel to the x-axis in a positive direction, and segment e, a vertical element extending parallel to the y-axis in a negative direction. Segment g is connected to one end of central segment f and segment e is connected to the other end of segment f. Segment d is connected to the other end of segment e and segment h to the outer end of segment g. Segments d and h are both about $\frac{1}{8}\lambda$ in length, with a total length equal to that of segment f, and extend in opposite directions along the z-axis towards each other. Segments e, f, and g are each about $\frac{1}{4}\lambda$ in length with the length of segment f determining the resonant frequency of the resonating element since it determines the spacing between the horizontal segment a and vertical segment e. The exact spacing and the exact lengths of segments e and g are dependant on mutual coupling can be determined by computer optimization using standard wire antenna code.

Figure 3:
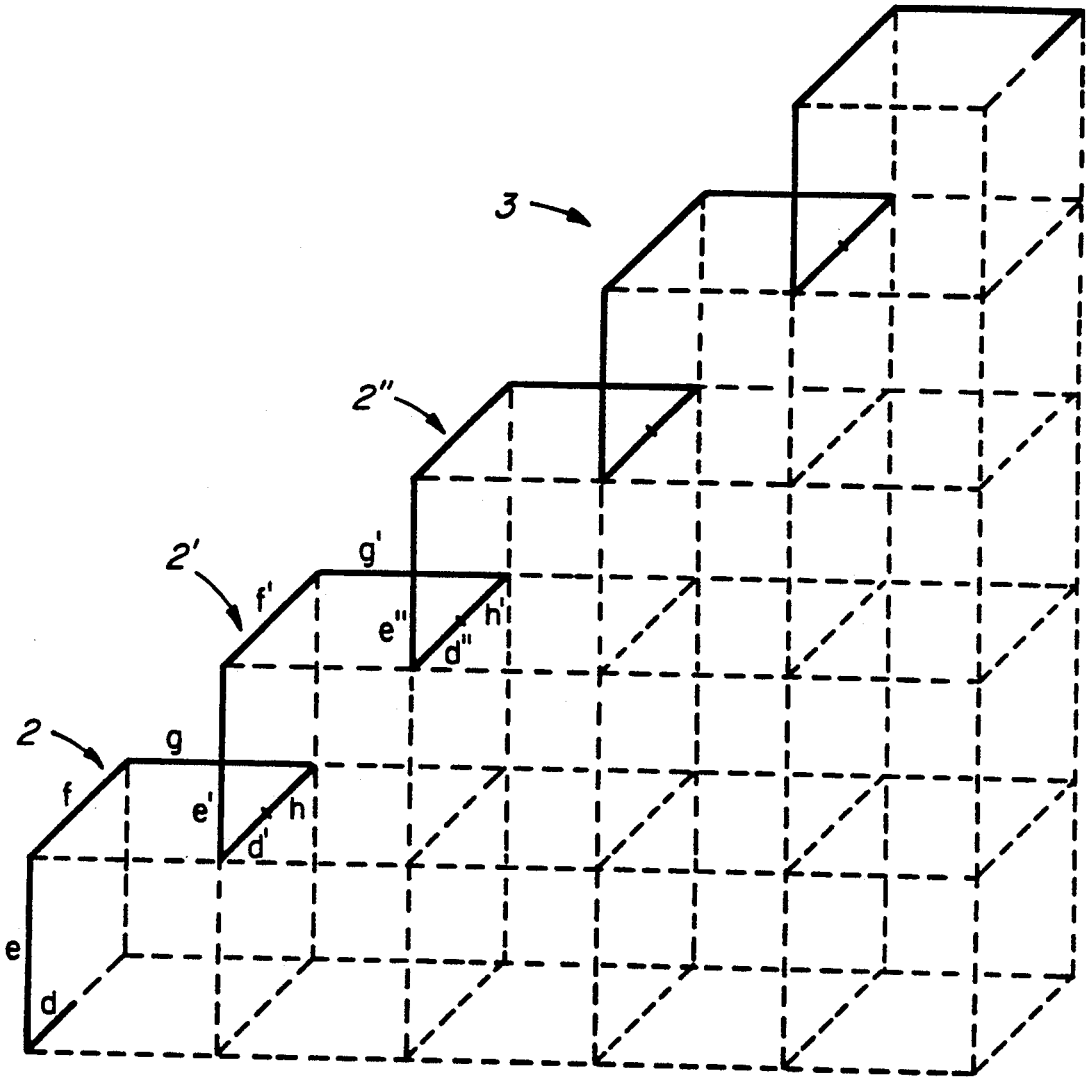
FIG. 3 illustrates a spiral array formed by 5 resonator elements of the type shown in FIG. 2 connected end-to-end.

A spiral 3, as illustrated in FIG. 3, is formed of identical resonating elements 2, 2', 2'', etc. connected end-to-end and displaced at 45° in the x-y plane. The segment h of element 2 is connected to segment d' of element 2' and segment h' of element 2' is connected to d'' of element 2'' and similarly for further resonating elements. FIG. 3 shows a spiral made up of five identical resonating elements. This type of spiral does not require any intermediate support structures, depending to a degree on its length and the mechanical strength of the resonating elements, and can be supported by structures located only at outer ends of the spiral. These support structures will, as a result, not interfere with the active area of an array of these spirals.

Figure 4:
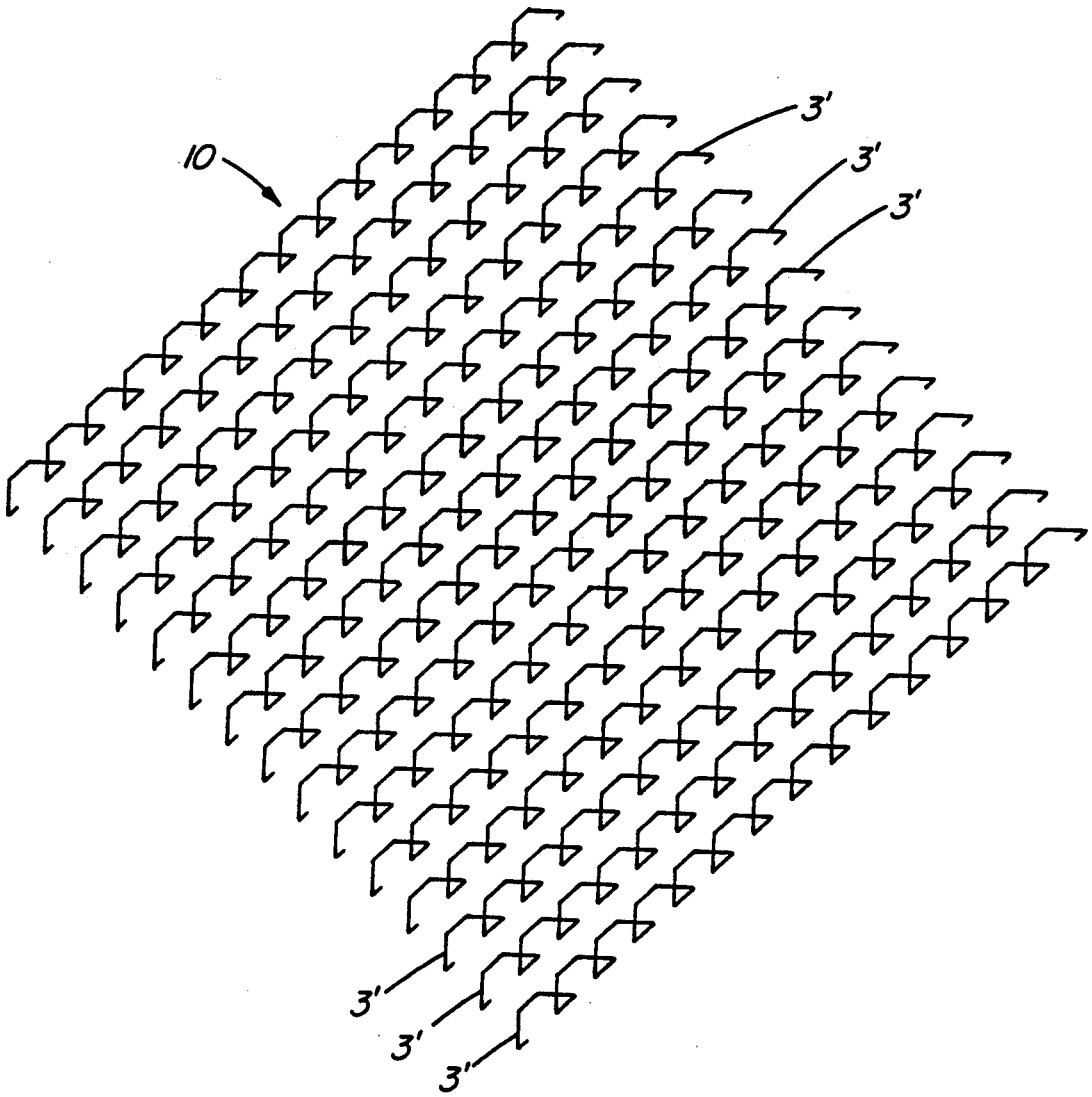
FIG. 4 illustrates a planar array according to the present invention made from 15 spirals, such as those shown in FIG. 3, with 14 resonating elements in each spiral.

A Circular Polarization Selective Surface 10, as shown FIG. 4, is fabricated by assembling a number of spirals 3', similar to spiral 3 in FIG. 3, in a plane and parallel to each other with all the central segments being oriented parallel to the z direction which is the direction of wave propagation. The Circular Polarization Selective Surface (CPSS) 10 in FIG. 4 contains 15 spirals 3' in which each spiral 3' is formed of 14 identical resonating elements similar to element 2 in FIG. 2. The spacing between the spirals 3' may vary from almost nothing up bout one wavelength. Each of the spirals 3' can be supported by their ends by a support structure which avoids the necessity of having to use any supporting dielectric in the active area of the Circular Polarization Selective Surface 10. However, for very long spirals, some extra support may be required such as an intermediate support near the center.

The properties of the Circular Polarization Selective Surface is mainly determined by the property of the resonating element 2 as shown in FIG. 2 from which the spirals 3 or 3' are formed. Element 2 will resonate strongly when a Right Hand Circularly Polarized (RHCP) wave, at its resonant frequency, is directed against the element along the z-axis. This will cause the RHCP wave to be reflected. However, a Left Hand Circularly Polarized (LHCP) wave at the resonant frequency and directed along the z-axis will not cause any resonance to be set up in element 2 which will then appear to be transparent to that LHCP wave. Since element 2 of FIG. 2 reflects RHCP waves, it is called a "right" element. A "left" element is one that reflects LHCP waves and is simply the mirror image of the element shown in FIG. 2, i.e. with segment g extending along the x-axis in the negative direction and segment h still attached to it and still pointing in the z direction.

Figure 5:
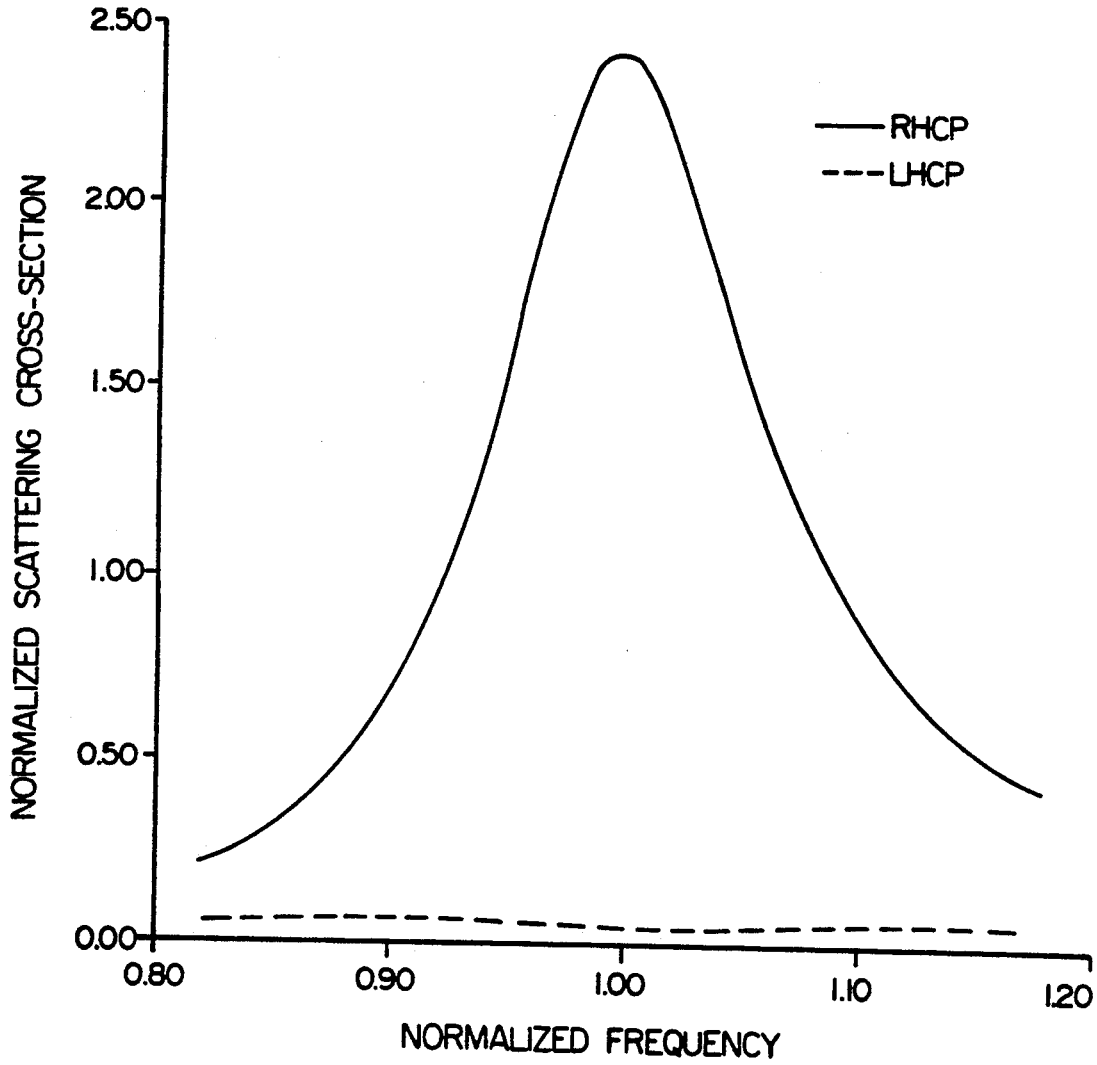
FIG. 5 is a graphical illustration of the Scattering Cross-Section versus Frequency for a Circular Polarization Selective Surface.

FIG. 5 shows the result of a computer simulation for a spiral formed from five resonating elements and gives the scattering cross-section for both RHCP (solid line) and LHCP (dashed line) waves. This graph illustrates that the surface scatters, actually strongly reflects, a RHCP wave at the resonate frequency but is almost invisible and, therefore, transparent for a LHCP wave.

Figure 6A:
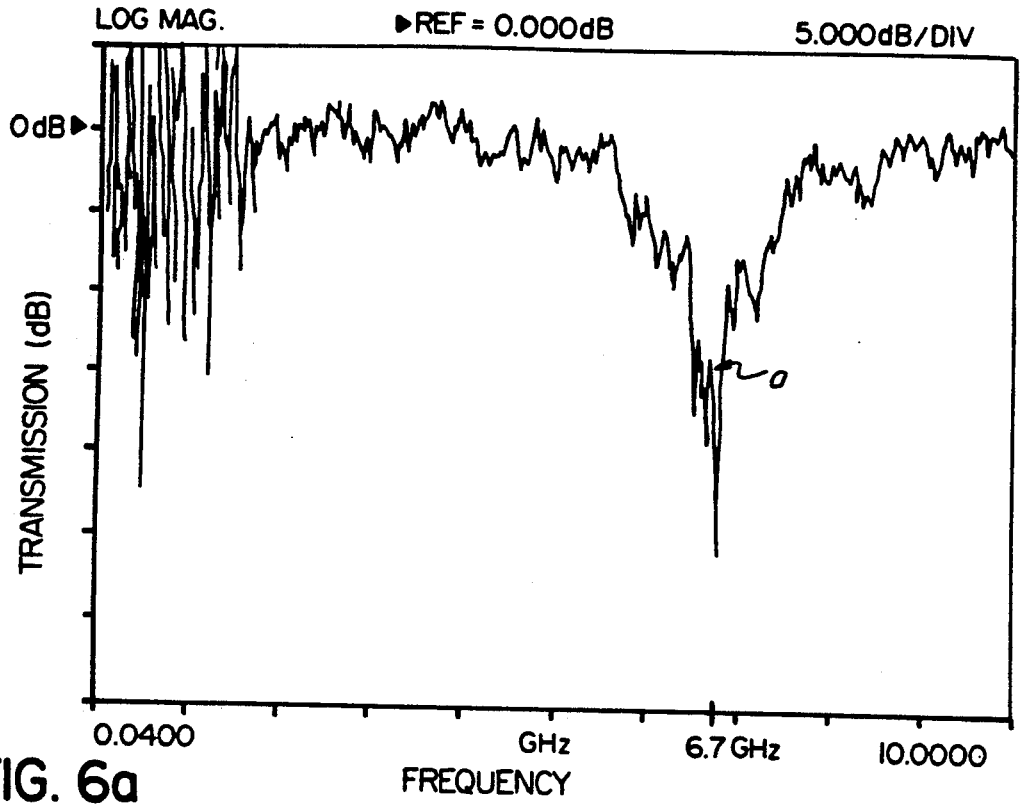
FIG. 6(*a*) is a graph of a transmission measurement versus frequency made on a Right-Hand Circular Polarization Selective Surface for a Right-Hand Circular Polarized wave and FIG. 6(*b*) is a similar graph for a Left-Hand Circular Polarized wave.
Figure 6B:
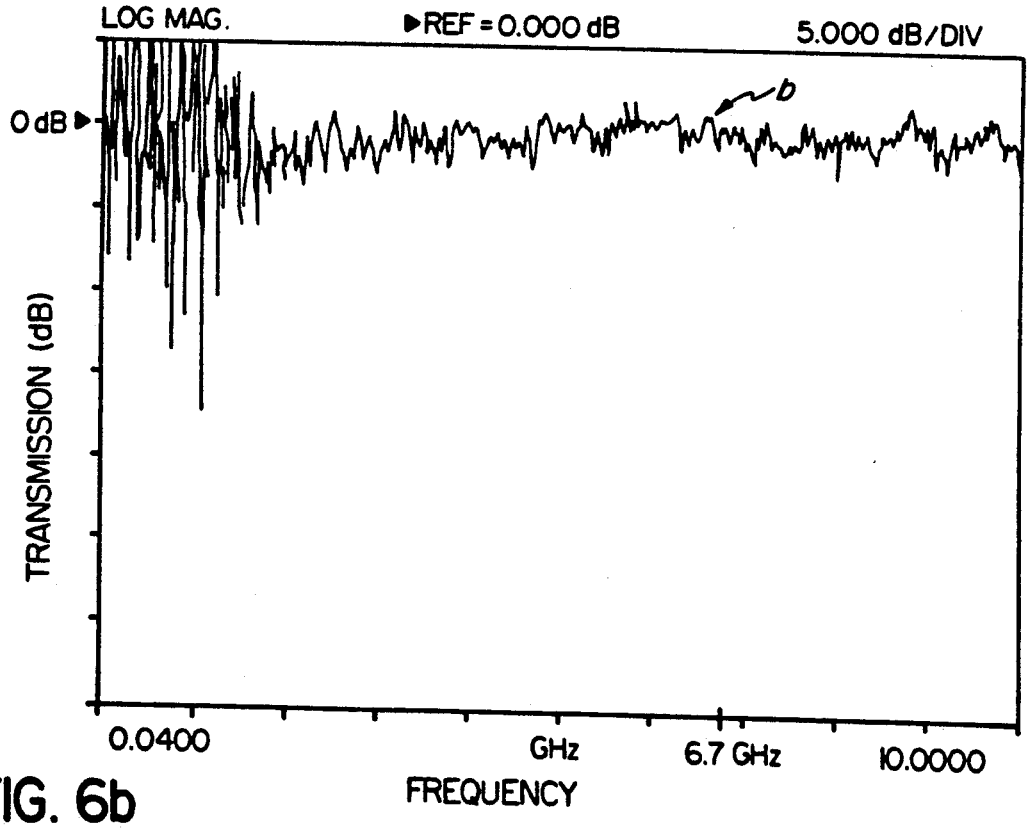

Transmission measurements have been made for a "right" CPSS fabricated with 10 spirals of 15 resonating elements each for both RHCP and LHCP waves with the results being shown in FIG. 6(*a*) and 6(*b*). FIG. 6(*a*) shows the transmission of that antenna for a RHCP wave and indicates at point "a" that a 15 dB drop in transmission occurs at 6.7 GHz due to wave reflection by the CPSS. FIG. 6(*b*) shows the transmission characteristic of that antenna for a LHCP wave and that the transmission is only slightly affected by the surface at a frequency of 6.7 GHz as indicated point "b".

Various modifications may be made to the preferred embodiments without departing from the spirit and scope of the invention as defined in the appended claims. For instance, the CPSS shown is ¼λ thick and planar. However, this surface can be shaped to make a curved surface such as a paraboloid or hyperboloid as long as the amount of curvature is not too strong.

What is claimed is:

1. A circular polarization selective surface for almost totally reflecting only one sense, while being almost transparent to the other sense, of an incoming circularly polarized wave having a wavelength X which propagates in a direction generally parallel to a z-axis of a right-hand set of three mutually perpendicular axes x, y and z; wherein the circular polarization selective surface comprises at least one resonating element having a multiplicity of electrically conductive segments, each segment having a predetermined length and being connected end-to-end one to the other, a central segment having length of about ¼λ extends generally parallel to the z-axis with a second segment being connected to one end of the central segment, the second segment extending parallel to the x-axis, and a third segment having about the same length as the second segment being connected to the central segment's other end, the third segment extending parallel to the y-axis, the resonating element having shorter segments of approximately equal lengths connected to outer ends of the second and third segments, wherein the shorter segments together have a total length equal to the central segment's length and extend parallel to the z-axis in opposite directions towards each other with the total length of all the segments being about 1λ).

2. A circular polarization selective surface as defined claim 1 wherein the second segment is connected to the central segment and extends parallel to the x-axis in a positive direction with the third segment being connected to the central segment and extending parallel to the y-axis in a positive direction forming a resonating element that is resonant for a left hand circularly polarized wave.

3. A circular polarization selective surface as defined claim 2, wherein a number of the resonating elements are connected together as to form a spiral with an outer end of one of the shorter segments of one resonating element being connected to an outer end of another shorter segment of an adjacent resonating element with all of the second segments extending in the same direction parallel to the x-axis and all of the third segments extending in the same direction parallel to the y-axis.

4. A circular polarization selective surface as defined claim 3, wherein a number of the spirals are arranged parallel to each other in a single plane and all their central segments are parallel and perpendicular to the plane.

5. A circular polarization selective surface as defined in claim 4, wherein the spirals are spaced apart in the plane by a distance of at most 1λ.

6. A circular polarization selective surface as defined claim 5, wherein the spirals are supported by structures connected at ends of the spirals.

7. A circular polarization selective surface as defined claim 6, wherein at least one further support structure is connected to the spirals intermediate their ends.

8. A circular polarization selective surface as defined claim 1, wherein the second segment is connected to the central segment and extends parallel to the x-axis in a positive direction with the third segment being connected to the central segment and extending parallel to the y-axis in a negative direction forming a resonating element that is resonant for a right hand circularly polarized wave.

9. A circular polarization selective surface as defined claim 8, wherein an number of the resonating elements are connected together as to form a spiral with an outer end of one of the shorter segments of one resonating element being connected to an outer end of another shorter segment of an adjacent resonating element, all of the second segments extending in the same direction parallel to the X-axis and all of the third segments extending in the same direction parallel to the y-axis.

10. A circular polarization selective surface as defined claim 9, wherein a number of the spirals are arranged parallel to each other in a single plane and all their central segments are parallel and perpendicular to the plane.

11. A circular polarization selective surface as defined in claim 10, wherein the spirals are spaced apart in the plane by a distance of at most 1λ.

12. A circular polarization selective surface as defined in claim 11, wherein the spirals are supported by structures connected to ends of the spirals.

13. A circular polarization selective surface as defined claim 12, wherein a further support structure is connected to the spirals intermediate their ends.

14. A circular polarization selective surface as defined claim 1, wherein a number of the resonating elements are connected together as to form a spiral with an outer end of one of the shorter segments of one resonating element being connected to an outer end of another shorter segment of an adjacent resonating element, all of the second segments extending in the same direction parallel to the x-axis and all of the third segments extending in the same direction parallel to the y-axis.

15. A circular polarization selective surface as defined claim 14, wherein a number of the spirals are arranged parallel to each other in a single plane and all their central segments are parallel and perpendicular to the plane.

16. A circular polarization selective surface as defined claim 15, wherein the spirals are spaced apart in the plane by distance of at most 1λ.

17. A circular polarization selective surface as defined in claim 16, wherein the spirals are supported by structures connected to ends of the spirals.

18. A circular polarization selective surface as defined in claim 17, wherein a further support structure is connected to the spirals intermediate their ends.

* * * * *